US009272177B2

(12) United States Patent
Befeld

(10) Patent No.: US 9,272,177 B2
(45) Date of Patent: Mar. 1, 2016

(54) SEATED POSTURE ABDOMINAL EXERCISE DEVICE

(71) Applicant: Robert Befeld, Crandall, TX (US)

(72) Inventor: Robert Befeld, Crandall, TX (US)

(73) Assignee: Robert A. Befeld, Crandall, TX (US)

( * ) Notice: Subject to any disclaimer, the term of this patent is extended or adjusted under 35 U.S.C. 154(b) by 63 days.

(21) Appl. No.: 13/763,666

(22) Filed: Feb. 9, 2013

(65) Prior Publication Data

US 2014/0051557 A1 Feb. 20, 2014

Related U.S. Application Data

(60) Provisional application No. 61/683,199, filed on Aug. 14, 2012.

(51) Int. Cl.

| | |
|---|---|
| ***A63B 21/04*** | (2006.01) |
| ***A63B 21/055*** | (2006.01) |
| ***A63B 21/16*** | (2006.01) |
| ***A63B 23/02*** | (2006.01) |

(52) U.S. Cl.

CPC ..... *A63B 21/0552* (2013.01); *A63B 21/0442* (2013.01); *A63B 21/16* (2013.01); *A63B 21/4003* (2015.10); *A63B 23/0211* (2013.01); *A63B 2208/0233* (2013.01)

(58) Field of Classification Search

CPC ..... A63B 21/0552; A63B 21/1415; A63B 21/02; A63B 21/04; A63B 21/0407; A63B 21/0414; A63B 21/0442; A63B 21/055; A63B 21/0555; A63B 21/0557; A63B 23/00; A63B 23/02; A63B 23/0205; A63B 23/0211; A63B 23/0216; A63B 23/0222; A63B 23/0227; A63B 23/0233; A63B 23/0238; A63B 23/025

USPC ..... 482/121, 130; 297/391–410, 464; D16/101, 300–342; 403/209, 212

See application file for complete search history.

(56) References Cited

U.S. PATENT DOCUMENTS

| | | | | | |
|---|---|---|---|---|---|
| RE4,193 | E | * | 12/1870 | Dederick | 297/393 |
| 2,210,520 | A | * | 8/1940 | Barry | 403/212 |
| 2,741,412 | A | * | 4/1956 | Hinkle | 297/467 |
| 2,835,012 | A | * | 5/1958 | Reiter | 403/212 |
| 3,709,217 | A | * | 1/1973 | Powers | 602/32 |
| 3,795,243 | A | * | 3/1974 | Miller | 602/36 |
| 4,019,734 | A | * | 4/1977 | Lee et al. | 482/125 |
| 4,026,549 | A | * | 5/1977 | Gunn | 482/124 |
| 4,339,151 | A | * | 7/1982 | Riggs | 297/464 |
| 4,478,414 | A | * | 10/1984 | Molloy | 482/123 |
| 4,645,198 | A | * | 2/1987 | Levenston | 482/10 |
| 5,141,482 | A | * | 8/1992 | Hern | 482/130 |
| 5,242,347 | A | * | 9/1993 | Keeton | 482/102 |
| 5,395,158 | A | * | 3/1995 | Cordia | 297/393 |

(Continued)

*Primary Examiner* — Loan H Thanh
*Assistant Examiner* — Andrew S Lo

(57) ABSTRACT

The present invention is directed to a device for abdominal exercise in a seated position using a seat. The device comprises a first elastic band, a second elastic band, a pair of couplings, and a harness. The elastic bands are of a configured length and resistance and have a first end extending to a distal second end. The coupling is secured at the first end of the elastic bands and operable to secure the device to the seat. The harness has a first and second end and presents a partial perimeter. The second end of the first elastic band is joined to the first end of the harness, the second end of the second elastic band is joined to the second end of the harness, whereby the continuously joined first elastic band, harness, and second elastic band present a partial perimeter for user engagement.

7 Claims, 2 Drawing Sheets

(56) References Cited

U.S. PATENT DOCUMENTS

| | | | | | |
|---|---|---|---|---|---|
| 5,511,854 | A * | 4/1996 | Cordia | 297/393 |
| 5,743,838 | A * | 4/1998 | Willis | 482/124 |
| 5,964,504 | A * | 10/1999 | Hogan et al. | 297/397 |
| 6,013,014 | A * | 1/2000 | Hern | 482/121 |
| 6,159,133 | A * | 12/2000 | Shugg | 482/130 |
| 6,301,716 | B1 * | 10/2001 | Ross | 2/171 |
| 6,461,283 | B1 * | 10/2002 | Maron | 482/123 |
| 6,607,245 | B1 * | 8/2003 | Scher | 297/393 |
| 6,859,965 | B1 * | 3/2005 | Gourd | 5/646 |
| 7,441,292 | B2 * | 10/2008 | Williams et al. | 5/636 |
| 7,468,019 | B2 * | 12/2008 | Zylstra | 482/10 |
| 8,287,045 | B1 * | 10/2012 | Donohue et al. | 297/393 |
| 2004/0124685 | A1 * | 7/2004 | Buch | 297/393 |
| 2007/0232974 | A1 * | 10/2007 | Serola | 602/19 |
| 2010/0126902 | A1 * | 5/2010 | Garza et al. | 206/579 |
| 2011/0031799 | A1 * | 2/2011 | DeJoode | 297/464 |
| 2013/0009445 | A1 * | 1/2013 | Cooper | 297/468 |
| 2013/0020853 | A1 * | 1/2013 | Gibson | 297/464 |
| 2014/0145487 | A1 * | 5/2014 | Donohue et al. | 297/393 |

* cited by examiner

SEATED POSTURE ABDOMINAL EXERCISE DEVICE

PRIORITY

The present invention claims priority to provisional application 61/683,199, which has a filing date of Aug. 14, 2012, which is incorporated by reference.

BACKGROUND

1. Field of the Invention

The present invention relates to an exercise device, more specifically to a device for exercising the abdominal muscles.

2. Description of the Related Art

A well-rounded exercise regimen is considered necessary for good health. But time for exercise and space for exercise equipment are both common barriers to exercise for many people. Part of a well-rounded exercise routine includes exercising the human abdomen. Lack of abdominal exercise can lead to various conditions such as back problems. Situps have long been a popular exercise for strengthening and toning the abdominal muscles. Typically, a person performing a conventional situp lies with the back and the feet on a flat surface, with the knees bent and raised from the floor. A person performing the situp places the hands behind the head with the elbows forward. The person then lifts the head and shoulders pivoting at the waist/hip region bringing the elbows to the knees. The abdominal muscles are strengthened by overcoming gravity's effect on the weight of the body above the waist/hip region. More recently, a "crunch" has become an acceptable alternative to the traditional situp. The crunch is performed in a similar manner, except the elbows are not brought completely to the knees. The lesser range of motion of the crunch has been found a satisfactory form of abdominal exercise. However, both the traditional situp and contemporary crunch require wide open space to perform.

A number of fitness devices have been created to aid in abdominal exercise. The devices often include weights or other space consuming mechanics, the need to attach to large immobile surfaces such as a door or wall, or require use of the hands to operate the device during exercise.

It would be advantageous for the art to have a device which enables abdominal exercise in a seated posture in compact space in a time-efficient manner with hands-free operation during the exercise.

SUMMARY

The present invention is directed to a device for abdominal exercise in a seated position. The device includes at least one coupling, at least one band having a first and second end, and a harness having a first and second end. A first coupling includes a closed loop connector operable to enclose a seat post. The first coupling is joined to a first band, proximate its first end. The first band has a configured length and resistance. The second end of the first band is joined to the first end of the harness. A second coupling includes a closed loop connector operable to enclose a seat post. The second coupling is joined to a second band, proximate its first end. The second band has a configured length and resistance. The second end of the first band is joined to the second end of the harness, such that the first coupling is contiguous with the first band, harness, second band, and second coupling. The continuously joined piece can be manipulated to form a perimeter around an enclosure where the user's applies force against the harness in order to exercise the abdomen.

These and other features, aspects, and advantages of the invention will become better understood with reference to the following description, and accompanying drawings.

DETAILED DESCRIPTION

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
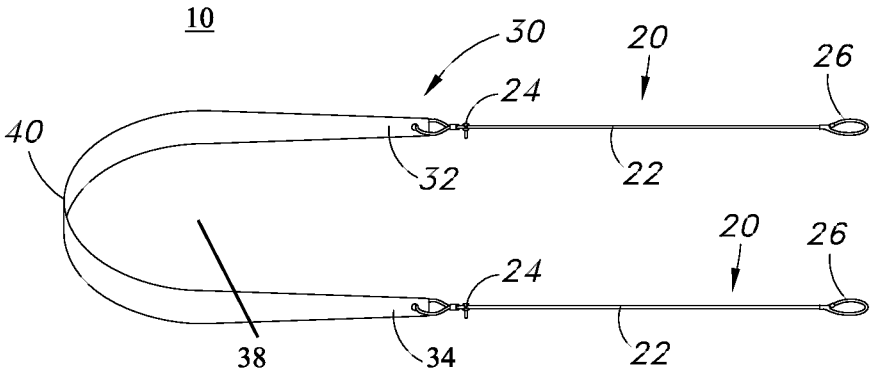
FIG. 1 depicts a front perspective view of an embodiment of the current invention.
Figure 2:
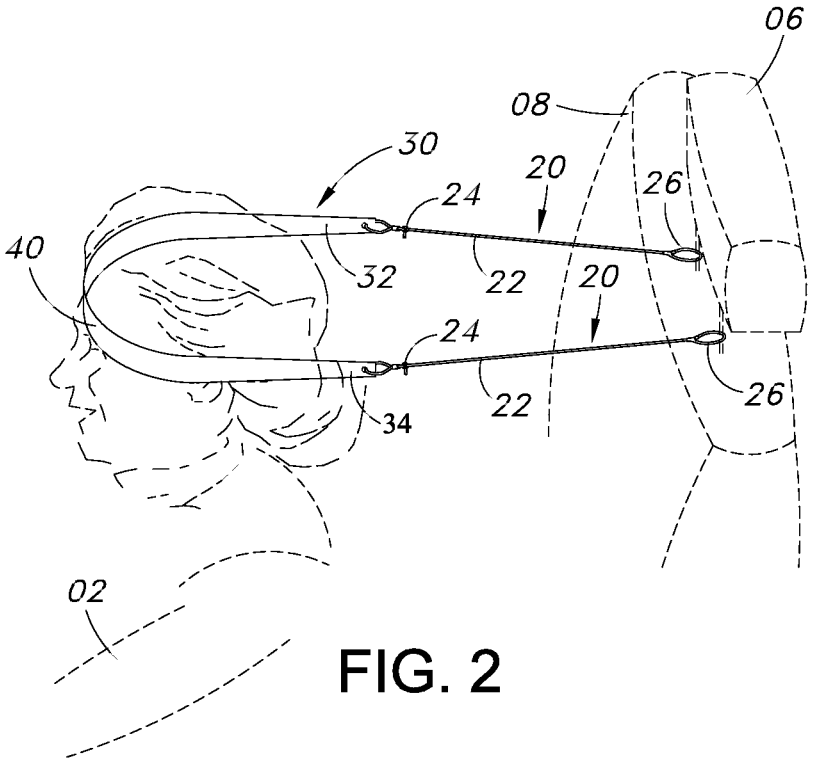
FIG. 2 depicts a side perspective view of the embodiment of FIG. 1 as it may exist in use.

The present invention is directed to a device for hands-free, abdominal exercise in a seated posture. FIG. 1 illustrates an embodiment of the abdominal exercise device 10 and FIG. 2 illustrates the embodiment secured to seat posts 04 of an automobile seat 08. Illustrated are a coupling 26, a band 20, and a harness 30. In exemplary operation, the device 10 is removably secured to a seat 08. In further exemplary use, the device 10 is secured to the seat posts 04, although it may be secured at other points, such as the headrest 06.

Figure 3:
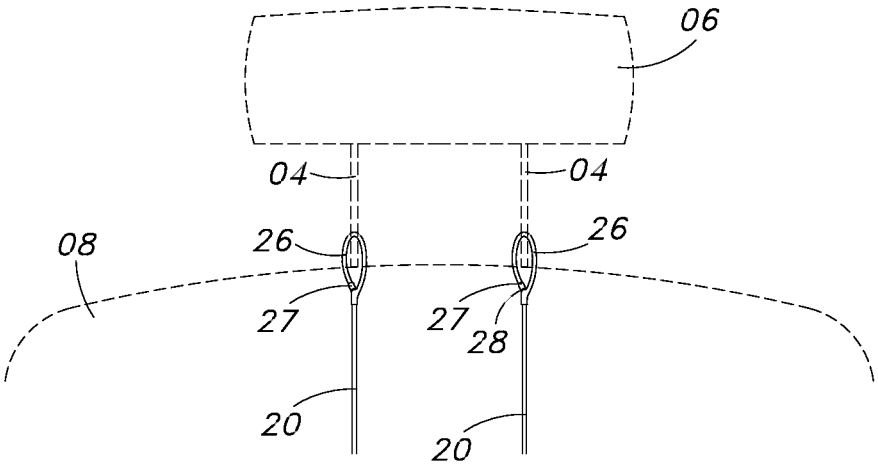
FIG. 3 depicts a frontal view of the couplings of the embodiment of FIG. 1.

Referring to FIG. 2, the abdominal exercise device 10 includes at least one coupling 26. The coupling 26 is operable to attach the device 10 to a post 04, preferably a substantially vertically oriented post 04 capable of opposing the applied generally transverse force of the device 10 in use. Illustrated posts 04 are those disposed between a seat 08 and a headrest 06. The depicted coupling 26 includes a selectively closed loop. It has a first end 27 and a corresponding mating, second end 28 of slightly less width, whereby the first end 27 can be slideably engaged over the second end 28 to selectively close the loop, presenting a perimeter wherein the post 04 can be enclosed. In the current embodiment, the coupling 26 includes a detachably engaging loop. However, it is within the spirit of the invention to include an alternate coupling 26 such as, but not limited to, an integral loop or a "hook" style coupling 26. Further, although FIG. 3 illustrates two couplings 26, it is within the spirit of this invention to employ a single coupling 26.

The coupling 26 is joined to an elastic band 20 which is operable to provide a configured resistance. The band 20 is a length of material having a first end 22 and a second end 24. The first end 22 of the band 20 is joined to the coupling 26. The depicted band 26 is integrally joined with the coupling 26, however it is within the scope of this invention to mechanically or chemically join the coupling 26 to the band 20. The band 20 extends distally from the coupling 26 to its second end 24.

Now referring to FIG. 2, the band 20 is preferably composed of rubber compositions or other suitable elastomeric materials. The band's 20 resistance is configured by altering its length and/or its composition. The exemplary length is one which the harness 30 rests on the user 02 with little resistance when the user's 02 head is close to the seat while providing resistance, allowing for a slight radius of curvature, when the user's head is extending distally to the seat 08. Configurable aspects of the composition of the band 20 include, but are not limited to its elasticity, modulus, elongation, restoring force, pre-stress and strain length, post-stress and strain length.

The device 10 includes a harness 30, operable to form a partial perimeter around the user 02 and contact the user 02. The harness 30 includes a belt 40 having a first end 32 and a second end 34. The belt has an outer surface 44 and an inner surface 42. The belt 40 is dimensioned to contact and cover a portion of the user 02, preferably the forehead, and distribute the resistive force provided by the bands 20 over the belt 40 and, in turn, to user 02 contact region. It is preferably dimensioned to avoid "digging" into the user's skin. The illustrated belt 40 is a swath of fabric about 18 inches in length and about two inches in height, with the height tapering at its ends 32 34. The belt 40 is optionally composed of moisture wicking material, where the moisture is wicked towards the ends 32 34 or outer surface 44. Optionally, the belt 40 is composed of material which is slip resistant to skin or clothing.

The current embodiment of the device 10 includes two bands 20. The second end 24 of a first band 20 is joined to the first end 32 of the harness 30. The second end 24 of a second band 20 is joined to the second end 34 of the harness 30. The continuously joined first band 20, harness 30, and second band 20 present a perimeter surrounding an enclosure 38 where the user 02 may insert his head.

In an alternate embodiment, the device 10 includes a single band 20. The second end 24 of the single band 20 is joined to the first end 32 of the harness 30. Additionally, the second end 24 of the single band 20 is joined to the second end 34 of the harness 30, whereby the belt 40 presents a perimeter surrounding an enclosure 38.

Figure 4:
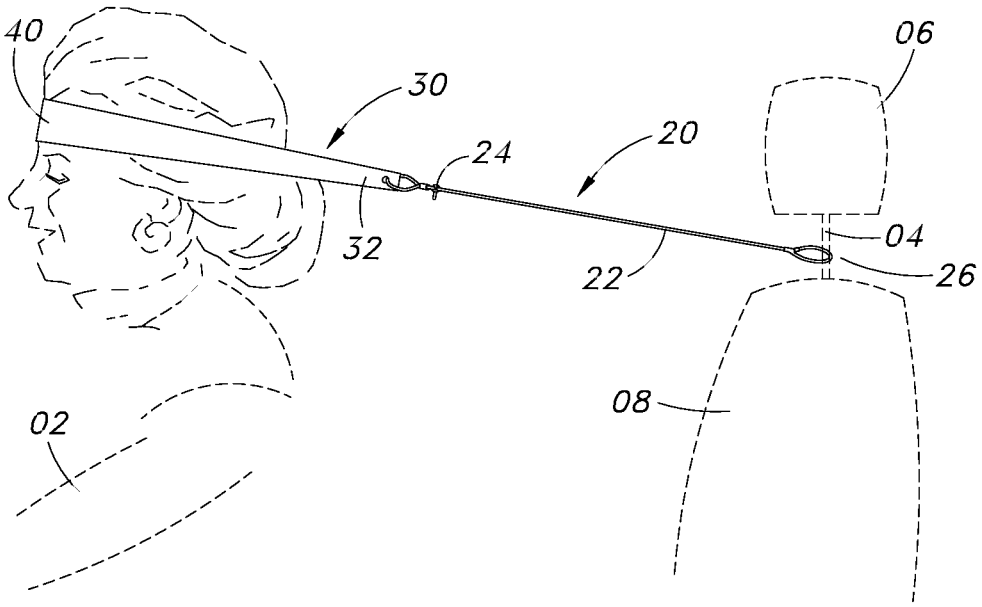
FIG. 4 depicts a side view of the embodiment of FIG. 1 as it may exist in use.

Referring to FIG. 4, use of an embodiment of the abdominal exercise device 10 is shown. User 02 secures the coupling 26 to the posts 04 of the seat 08 with the bands 20 and harness 30 extending frontally and distally from the seat 08. In a seated posture, user 02 then places his or head through the enclosure 38 bounded by the harness 30 and bands 20. User 02 rests his or head against the interior surface of the belt 40. In order to engage in abdominal exercise, user 02 moves the head forward away from and distally to the seat 08 against the resistive force of the bands 20. User 02 then relaxes, wherein the elastic, restorative force of the bands 20 aids returning the user 02 to his or her original position. Upon completion of exercise and leaving the seat 08, the device 10 can be left in the rested position of FIG. 5 in order to readily reengage the device 10.

Insofar as the description above and the accompanying drawing disclose any additional subject matter that is not within the scope of the single claim below, the inventions are not dedicated to the public and the right to file one or more applications to claim such additional inventions is reserved.

The invention claimed is:

1. A system for exercising a user's abdominal muscles in a seated position, said system comprising:

a vehicle seat headrest having at least one post; and an exercise device comprising:

a first elastic band, a second elastic band, a pair of selectively closed loops, and a harness; wherein said elastic bands are of a configured length and resistance and each having a first end extending to a distal second end;

wherein each selectively closed loop is secured at said first end of said elastic bands, each selectively closed loop coupled around a post of said seat headrest;

wherein the harness is comprised of a unitary, open body, single elongated fabric swath, having a first and second end and presenting a partial perimeter; and said second end of said first elastic band is joined inline to said first end of said harness, said second end of said second elastic band is joined inline to said second end of said harness, whereby the continuously joined first elastic band, harness, and second elastic band present a partial perimeter for user engagement on said user's forehead.

2. The system of the claim 1, wherein each of said selectively closed loop is coupled around a post of said seat headrest and comprises a loop fastener, said loop fastener presents a perimeter enabling a seat portion to be enclosed for user engagement.

3. The system of claim 2, wherein said loop fastener includes a first end with an opening and a second end dimensioned for slidable insertion into said opening.

4. The system of claim 1, wherein said selectively closed loop is configured for removably securing to said post on said seat headrest.

5. The system of claim 1, wherein said selectively closed loops are integral with said elastic bands.

6. The system of claim 1, wherein said harness is composed of moisture wicking material.

7. The system of claim 1, wherein said harness is composed of slip resistant material.

* * * * *